US007594477B2

(12) United States Patent
Arias et al.

(10) Patent No.: US 7,594,477 B2
(45) Date of Patent: Sep. 29, 2009

(54) RECONFIGURABLE BUOYANT APPARATUS

(75) Inventors: David A. Arias, Virginia Beach, VA (US); Alfred E. Grimm, Virginia Beach, VA (US); Monica Jones, Virginia Beach, VA (US)

(73) Assignee: Swimways Corporation, Virginia Beach, VA (US)

( * ) Notice: Subject to any disclaimer, the term of this patent is extended or adjusted under 35 U.S.C. 154(b) by 0 days.

(21) Appl. No.: 11/777,557

(22) Filed: Jul. 13, 2007

(65) Prior Publication Data

US 2009/0017707 A1 Jan. 15, 2009

(51) Int. Cl.
*B63B 35/44* (2006.01)

(52) U.S. Cl. ..... 114/267

(58) Field of Classification Search ..... 114/267
See application file for complete search history.

(56) References Cited

U.S. PATENT DOCUMENTS 3,822,499 A * 7/1974 De Vos ..... 446/121
4,997,375 A 3/1991 Heinz
5,302,148 A 4/1994 Heinz
5,460,114 A * 10/1995 McMillan ..... 114/267
5,498,190 A 3/1996 Ganson
5,525,089 A 6/1996 Heinz
5,769,994 A 6/1998 Booz et al.
5,916,006 A 6/1999 Ganson
6,482,063 B1 11/2002 Frigard

* cited by examiner

*Primary Examiner*—Lars A Olson
*Assistant Examiner*—Daniel V Venne
(74) *Attorney, Agent, or Firm*—Cooley Godward Kronish LLP

(57) ABSTRACT

In one embodiment, a buoyant device includes multiple buoyant members with each buoyant member defining a first aperture and a second aperture. Each buoyant member is coupled to an elongate member such that the elongate member extends from that first aperture to that second aperture.

28 Claims, 19 Drawing Sheets

RECONFIGURABLE BUOYANT APPARATUS

BACKGROUND

This invention relates to a buoyant device, and more particularly to an aquatic toy having a reconfigurable geometric configuration.

Numerous children's activity devices are useful to entertain and stimulate children playing in water. For example, some toy devices can be thrown into water, such as, for example, a pool. These devices can float on the surface of the water but have limited use because they have one pre-defined shape and configuration.

Thus, a need exists for a device that is buoyant and can have a user-specified geometric configuration.

SUMMARY OF THE INVENTION

In one embodiment, a buoyant device includes multiple buoyant members with each buoyant member defining a first aperture and a second aperture. Each buoyant member is coupled to an elongate member such that the elongate member extends from that first aperture to that second aperture. For example, in one embodiment the buoyant device also includes multiple retaining members with each retaining member being fixedly coupled to the elongate member and fixedly coupled to each buoyant member.

In another embodiment, the buoyant device can have at least one of a variety of different geometric configurations. For example, in one embodiment, the buoyant members collectively have a buoyancy configured to support a weight of an average user such that at least a portion of the user is above a surface of a liquid when disposed within the liquid. In other embodiments, multiple buoyant devices, each with multiple buoyant members, have collectively a buoyancy configured to support a weight of an average user when disposed within the liquid. The buoyant members are selectively positionable with respect to the elongate member to define a user-specified geometric configuration. In yet another embodiment, the elongate member is configured to limit a distance between each adjacent buoyant member.

DETAILED DESCRIPTION

The buoyant device described herein can be place into a liquid, such as, for example a pool of water. For example, the buoyant device can be configured as an aquatic activity device or toy having a user-defined geometric configuration. For example, a user can move the buoyant device from a first geometric configuration to a second geometric configuration. In some embodiments, the user uses the buoyant device to keep a portion of the user above the surface of the water.

Figure 1:
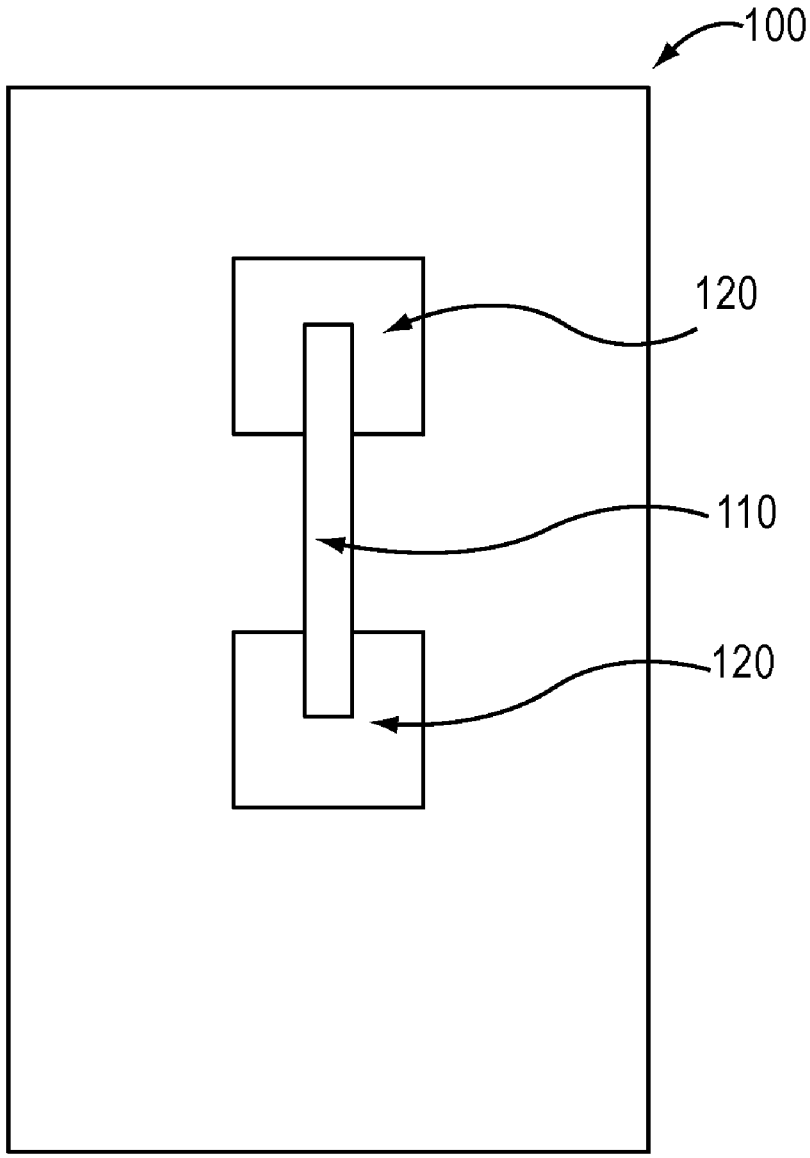
FIG. 1 is a schematic illustration of a buoyant device according to an embodiment of the invention.

FIG. 1 is a schematic illustration of a buoyant device according to an embodiment of the invention. An apparatus 100 (also referred herein as a "buoyant device") can be placed into a body of liquid. As shown in FIG. 1, the buoyant device 100 includes an elongate member 110 and buoyant members 120. The elongate member 110 is slidably coupled to the buoyant members 120.

In one embodiment, the buoyant members collectively have a buoyancy configured to support a weight of an average user such that at least a portion of the user is above a surface of a liquid when disposed within the liquid. In an alternative embodiment, the buoyant members collectively have a buoyancy configured to support a portion of a weight of an average user when disposed within a liquid. More specifically, the buoyant device can aid the buoyancy of the user. For example, the user or child can hold on to or sit on one or more of the buoyant devices to maintain a position at least partially afloat when disposed with a liquid such as, for example, a pool of water.

The buoyant members can collectively have a buoyancy configured to support at least a portion of a weight of a user. For example, various embodiments can support the weight of a user up to 40 lbs, 100 lbs, 200 lbs, or 325 lbs such that at least a portion of the user is above a surface of a liquid when disposed within the liquid. Alternatively, multiple buoyant devices can be used to support at least a portion of the user above the surface of a liquid. For example, three buoyant devices, each having a buoyancy configured to support the user a user up to 100 lbs., can be used to support a user that weighs 240 lbs. Similarly, other combinations of buoyant devices can be used by different users of different weights.

The buoyant members can collectively form a buoyant device having a length such as, for example, 0.5 ft, 1 ft, 2 ft, 3 ft, 4 ft, 5 ft or 6 ft. In some embodiments, the length of the buoyant device is associated with its buoyancy. For example, the 4 ft buoyant device can have a buoyancy configured to support a portion of the 40 lbs user when disposed within the liquid. In some embodiments, a buoyant device with a length of 6 ft can support a user of more weight than a buoyant device with a length 2 ft such that at least a portion of the user is disposed above the surface of the liquid.

Various embodiments of the buoyant device can have a specific gravity, for example, of 0.9, 0.94, 1.1, or 1.2 where specific gravity is a unitless measure of relative density with respect to water. In some embodiments, one buoyant member of the buoyant device can have a different specific gravity than the specific gravity of another buoyant member.

In some embodiments, each buoyant member can have the same buoyancy as the each of the other buoyant members. In other embodiments, a buoyant member can have a buoyancy different from another buoyant member of the buoyant device.

The buoyant members can be made from any material that provides the appropriate buoyancy and can be used in a liquid for extended periods of time, such as for example, a pool or a lake. For example, the buoyant members can be made from a synthetic material such as a polyurethane foam, a polyethylene foam, an expanded polystyrene or any other open cell or closed cell polymer. The buoyant members can be made from a homogenous materials, multiple non-homogenous materials, and can have an inflatable structure or a solid structure.

Figure 2:
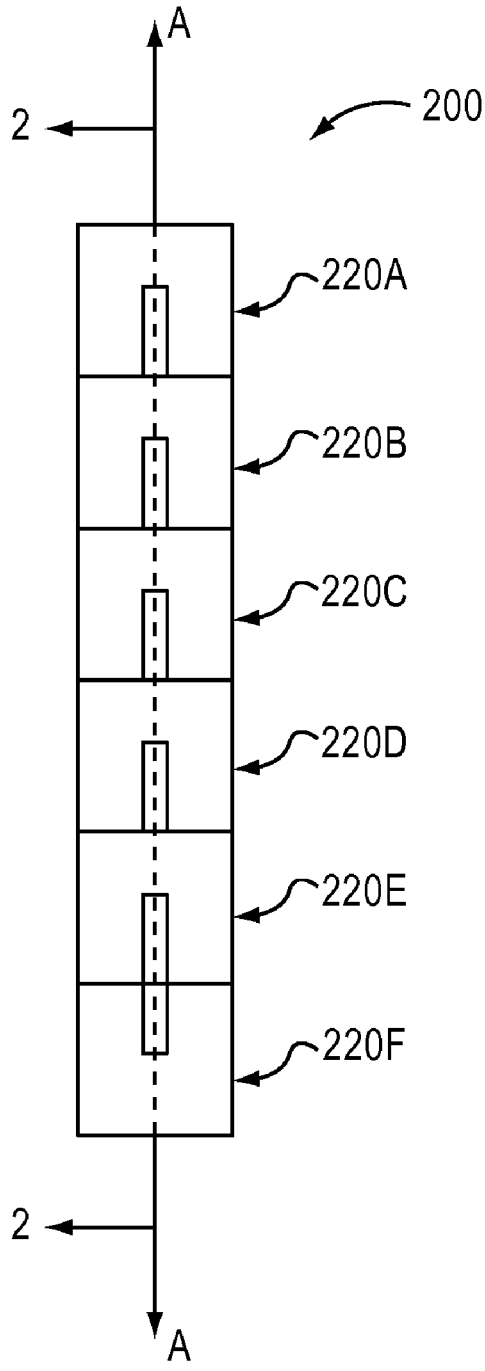
FIG. 2 is a side view of the buoyant device according to an embodiment of the invention.
Figure 2A:
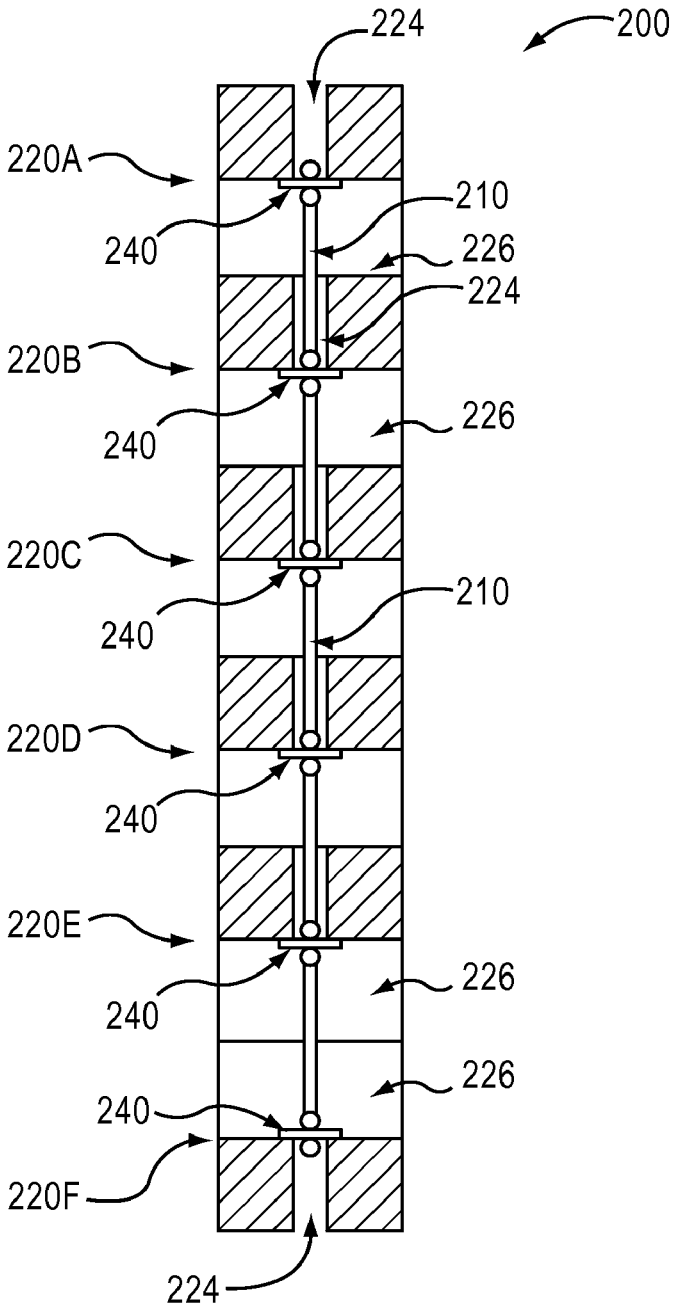
FIG. 2A is a cross-sectional view of the buoyant device along the line 2-2 of FIG. 2.

FIG. 2 is a side view of the buoyant device according to an embodiment of the invention. FIG. 2A is a cross-sectional view of the buoyant device along the line 2-2 of FIG. 2. As shown in FIGS. 2 and 2A, the buoyant device 200 includes an elongate member 210, buoyant members 220 and retaining members 240.

Each buoyant member 220 defines a first aperture 224 and a second aperture 226, and is coupled to the elongate member 210 such that the elongate member 210 extends from that first aperture 224 to that second aperture 226. Each retaining member 240 is fixedly coupled to the elongate member 210 and fixedly coupled to a buoyant member 220. In this embodiment, the buoyant members 220 are substantially cubic in shape, however, it should be understood that the buoyant members 220 can be any of a variety of different shapes and configurations, including for example, pyramidal, spherical, octagonal, etc. For example, the buoyant member can be a polyhedron block. In some embodiments, a buoyant member can have a different shape and configuration than that of another buoyant member.

Figure 3:
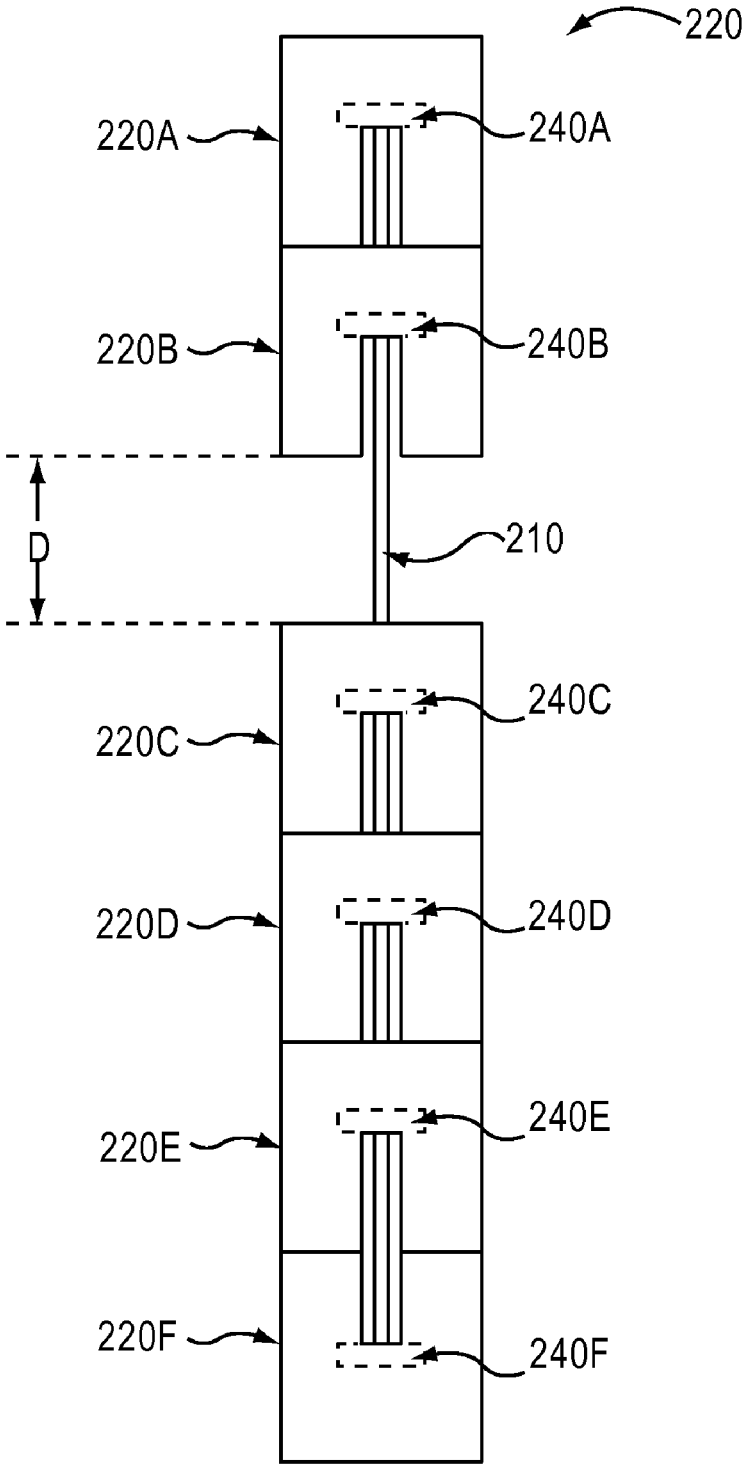
FIGS. 3 and 4 are side perspective views of the buoyant device of FIG. 2.
Figure 4:
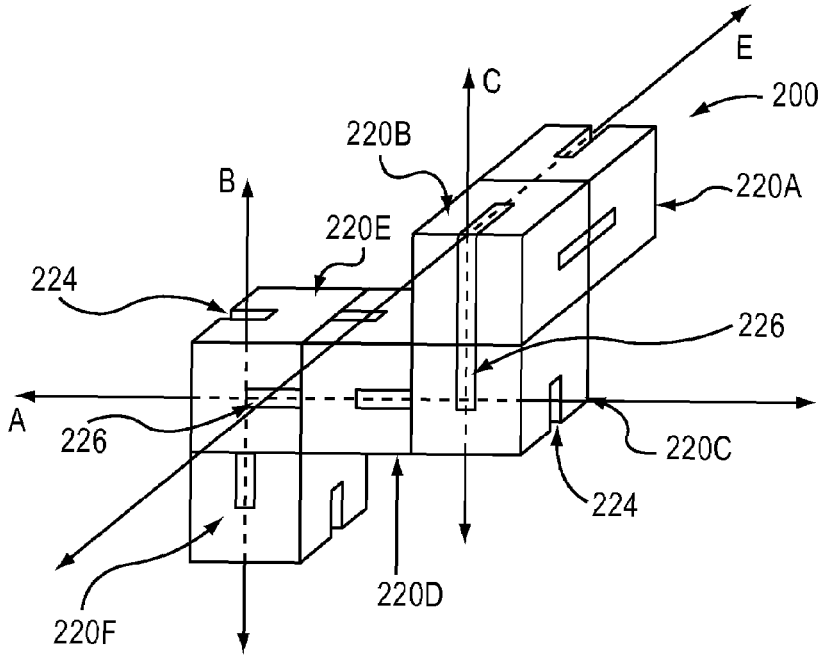

The elongate member 210 can be substantially taut and configured to hold the buoyant members 220 in an adjacent arrangement as shown in FIGS. 2-4. Adjacent retaining members 240B, 240C are configured to limit a distance D between two adjacent buoyant members 220B, 220C as shown in FIG. 3. Specifically, the retaining members 240 aid in retention of the elongate member 210 within each buoyant member 220, thereby limiting the length of elongate member between each buoyant member 220. For example, when the elongate member is elastic, the distance between each of the buoyant members can be increased. In such an embodiment, however, the elongate member has a maximum distance between one buoyant member and an adjacent buoyant member. Additionally, the elastic elongate member will return the buoyant members to an adjacent arrangement once the force stretching the elastic elongate member is removed.

A retaining member 240 can be, for example, a washer, a clamp, and the like. In some embodiments, each buoyant member is configured to retain a portion of the elongate member at a fixed location without a retaining member to limit a distance between an adjacent buoyant member. In such embodiments without a retaining member, the buoyant member has a rigidity sufficient to withstand forces produced by tension in the elongate member against the surface of the buoyant member without altering the structure of the buoyant member. In various embodiments (with or without retaining members), the elongate member can be coupled to the buoyant members with a tension such that a maximum distance between any two adjacent buoyant members is, for example, one inch, two inches or three inches.

In some embodiments, the elongate member 210 can be configured to aid in maintaining the position of the elongate member 210 within each buoyant member 220. Thus, the elongate member also limits the distance between adjacent members. For example, FIG. 3 shows the distance D between a buoyant member 220B to an adjacent buoyant member 220C when the elastic elongate member is stretched.

For example, the elongate member can have a first knotted portion and a second knotted portion within each buoyant member with a washer retaining member disposed therebetween. Both the first knotted portion and the second knotted portion have a width greater than a diameter defined by an inner aperture of the washer inhibiting their passage through the aperture such that the both the first knotted portion and the second knotted portion of the elongate member are retained with respect to the washer.

Figure 4A:
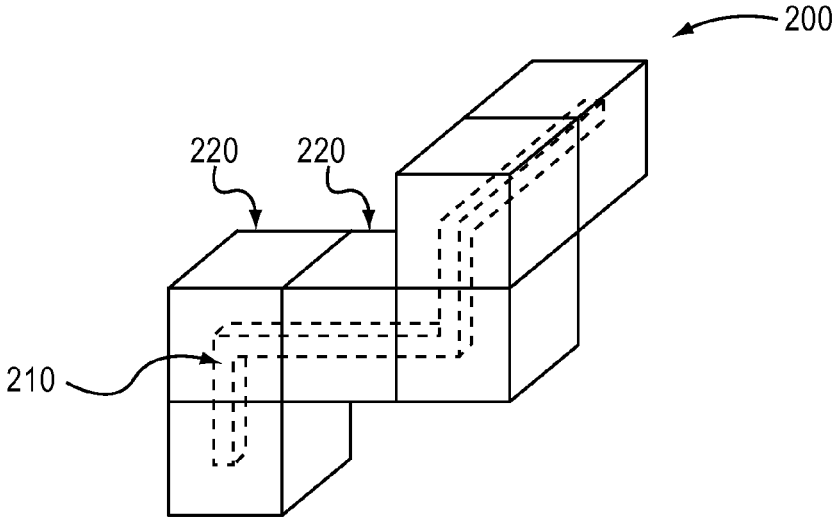
FIG. 4A is a side perspective view of the buoyant device of FIG. 4.

FIGS. 3 and 4 are side perspective views of the buoyant device of FIG. 2. As shown in FIG. 2, buoyant members 220 collectively form an elongate body and are selectively positionable with respect to the elongate member 210 to define a user-specified geometric configuration as shown in FIG. 4. More specifically, the buoyant device 200 has a first geometric configuration as shown in FIG. 2 and a second geometric configuration as shown in FIG. 4 different from the first geometric configuration. The buoyant members 220 are configured to move from the first geometric configuration to the second geometric configuration and vice versa. Specifically, three buoyant members 220B, 220C, and 220F have been pivoted with respect to the elongate member 210 and/or rotated with respect to the elongate member defined by the first geometric configuration. Additionally, the elongate member 210 moves to different positions associated with different portions of the first aperture and the second aperture of at least one of the buoyant members 220. More specifically, the first geometric configuration defines one axis A. While the second geometric configuration defines 4 independent and distinct axes A, B, C and E. The elongate member 210 is located at a substantially center location with respect to each buoyant member 220 as shown in FIG. 4A. The elongate member 210 travels along a portion of each of the axes A, B, C and E when in the buoyant device 200 is in the second geometric configuration.

Although, only two geometric configurations have been illustrated in FIGS. 3 and 4, it should be understood that multiple other geometric configurations can be specified by the user. The user can define any of a variety of different geometric shapes and configurations each defining one or more separate and distinct axes. For example, the buoyant members 220 can collectively form geometric configurations that are substantially, but are not limited to, S-shaped, J-shaped, circular, rectangular, ovular, etc., and any combination thereof.

In some embodiments, the total number of geometric configurations possible is associated with the number of apertures of each buoyant member. In some embodiments, the number of apertures of each buoyant member is more than one or two to allow an increased number of geometric configurations of the buoyant device. In some embodiments, the apertures can be any of a variety of different shapes, including for example, L-shaped, U-shaped, X-shaped, etc. In some embodiments, the apertures are off set from the center of the block. In some embodiments, the aperture is curved.

Figure 6:
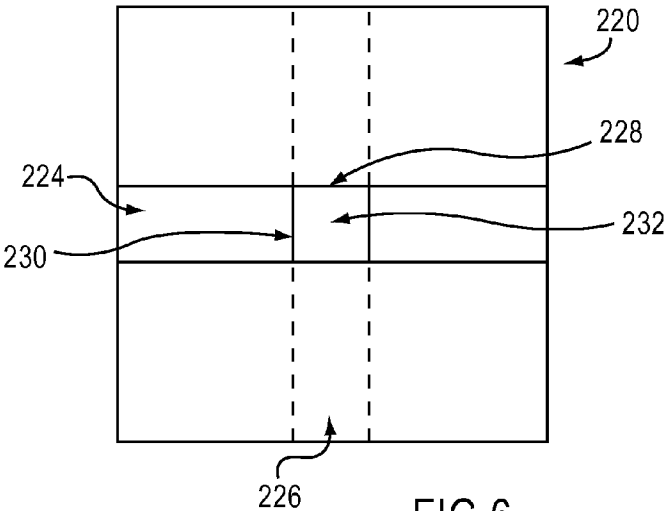
FIGS. 5-7 are perspective, top and side views, respectively, of a portion of the buoyant device of FIGS. 2-4.
Figure 5:
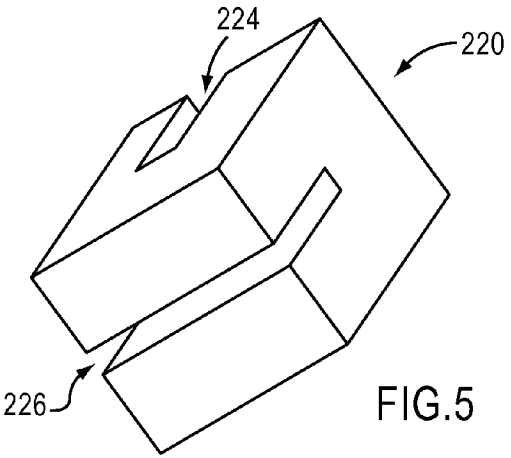
Figure 7:
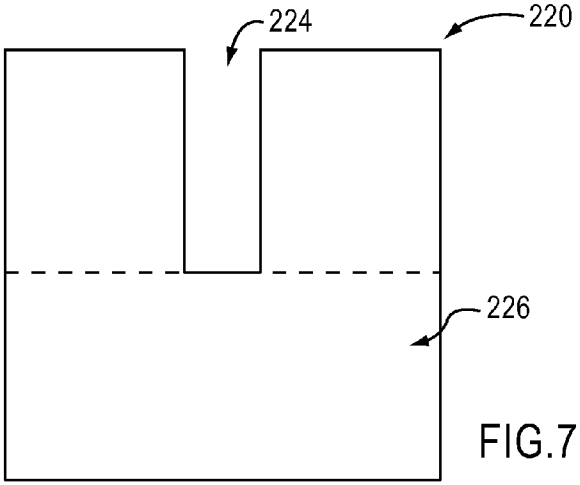

FIGS. 5-7 are perspective, top and side views, respectively, of a portion of the buoyant device of FIGS. 2-4. FIG. 5 illustrates a buoyant member 220 having a first aperture 224 and a second aperture 226. A portion of the wall 228 defining the first aperture 224 and a portion of the a wall 230 defining the second aperture 226 collectively define a hole 232 having an area associated with an area of a cross-section of the elongate member 210 as shown in FIG. 6. FIGS. 5-7 each illustrate the geometric relation of the first aperture 224 to the second aperture 226.

Figure 8:
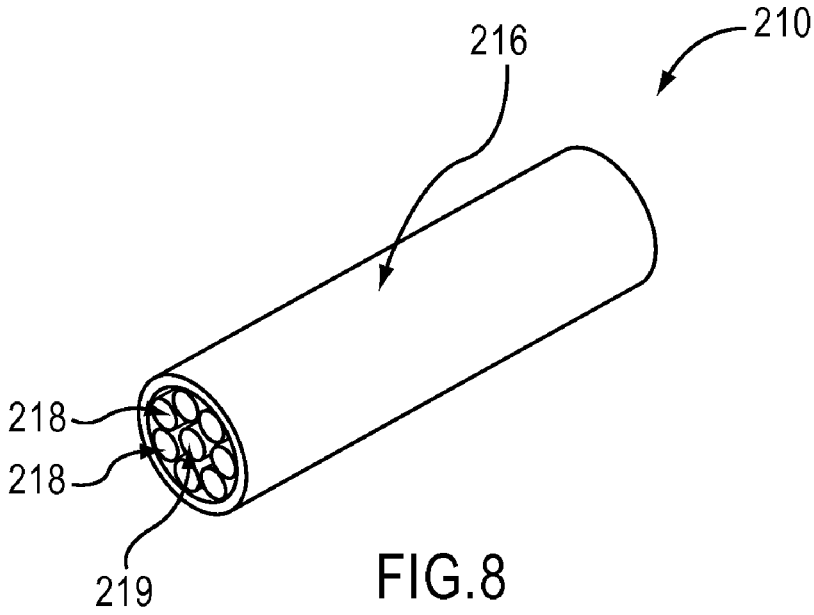
FIGS. 8 and 9 are perspective views of an elongate member of the buoyant device of FIGS. 2-7.
Figure 9:
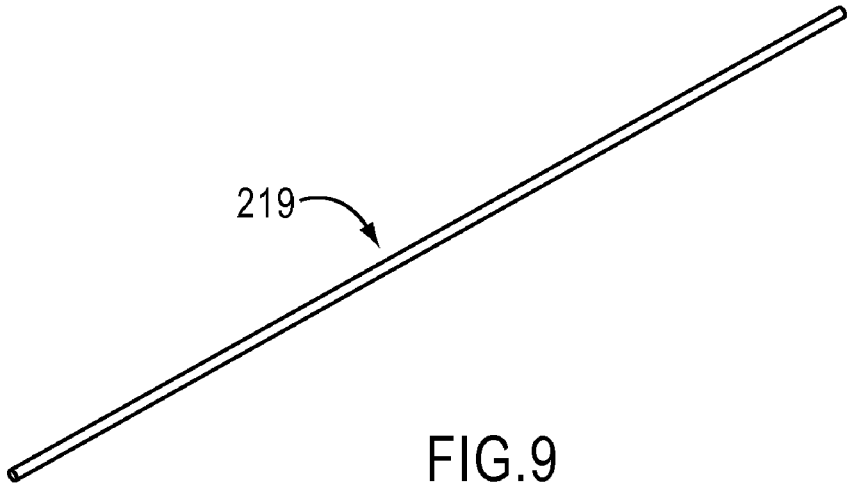
Figure 9A:
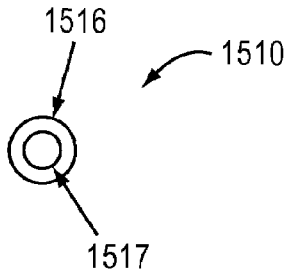
FIGS. 9A and 9B are side views of an elongate member of the buoyant device, according to an embodiment of the invention.
Figure 9B:
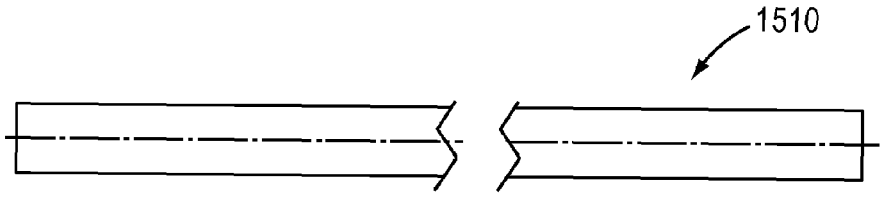

FIGS. 8 and 9 are perspective views of an elongate member of the buoyant device of FIGS. 2-7. The elongate member 210 includes a sheath 216 and strands 218 disposed within the sheath 216 as illustrated in FIG. 8. The sheath 216 protects the strands from damage by contact with the buoyant members 220, the retaining members 240, and external debris such as, for example, dirt, dust, etc. The strands 218 increase the durability of the elongate member 210. For example, the elongate member 210 can still function even if a strand 219 is damaged or breaks. The strand 219 is illustrated in FIG. 9. In one embodiment, the elongate member 210 is elastic to allow the elongate member 210 to increase its length to help permit the multiple geometric configurations discussed above. In an alternative embodiment, the elongate member 1510 includes a sheath 1516 that defines a lumen 1517 as shown in FIGS. 9A and 9B.

In some embodiments, the elongate member is composed of multiple elastic elongate member segments linked together. In some embodiments, the elongate member is a cord. In some embodiments, the elongate member is constructed from a rubber or rubber-like material. For example, the elongate member can be surgical tubing or the like.

Figure 10:
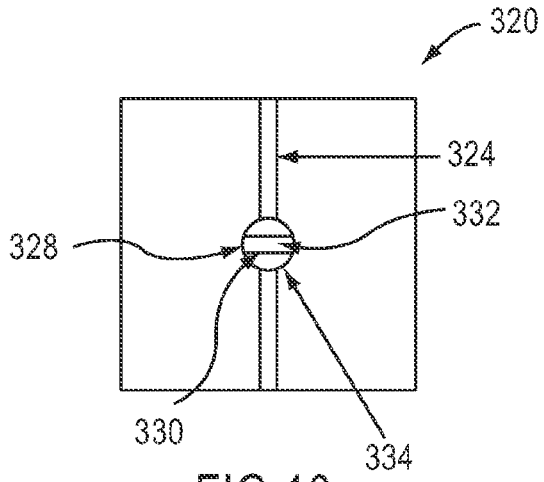
FIGS. 10-13 are top, perspective, side, and side views, respectively, of a portion of the buoyant device according to an embodiment of the invention.
Figure 11:
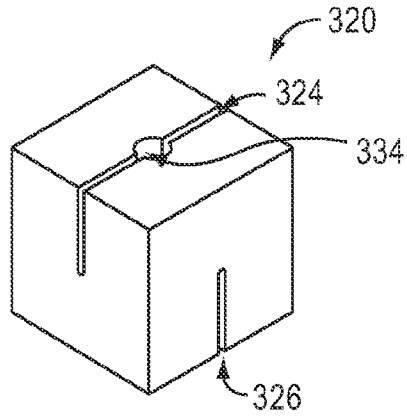
Figure 12:
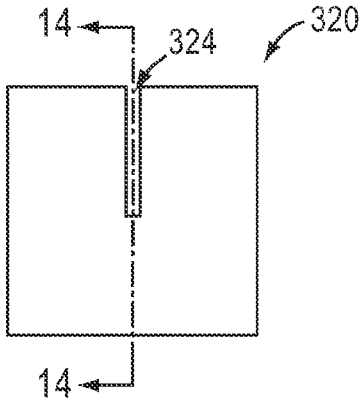
Figure 13:
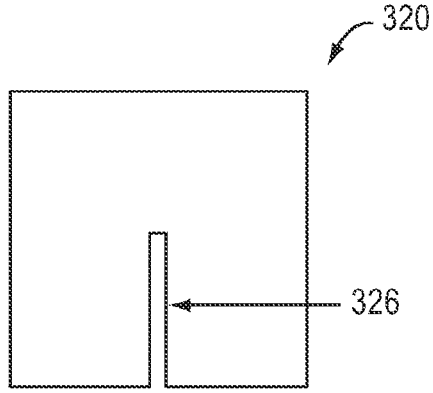
Figure 14:
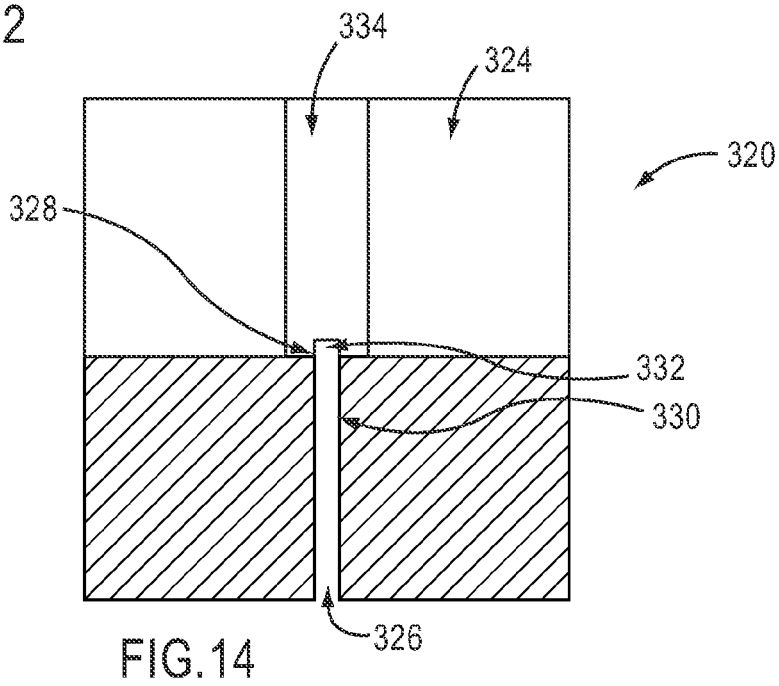
FIG. 14 illustrates a cross-section of the portion of the buoyant device along the line 14-14 of FIG. 12.

FIGS. 10-13 are top, perspective, first side and second side views, respectively, of a portion of the buoyant device according to an embodiment of the invention. FIG. 10 illustrates a buoyant member 320 defining a first aperture 324 and a second aperture 326, and is coupled to an elongate member such that the elongate member extends from that first aperture 324 to that second aperture 326. In this embodiment, the portion 334 of the first aperture 324 is substantially circular and located concentrically with the hole 332 defined by the portion of wall 328 defining the first aperture 324 and the portion of the wall 330 defining the second aperture 326. FIG. 14 illustrates a cross-section of the buoyant member 320 along the line 14-14 of FIG. 12. The substantially circular portion 334 of the first aperture 324 has a diameter associated with a diameter defined by a retaining member, such as, for example, a washer.

Figure 15:
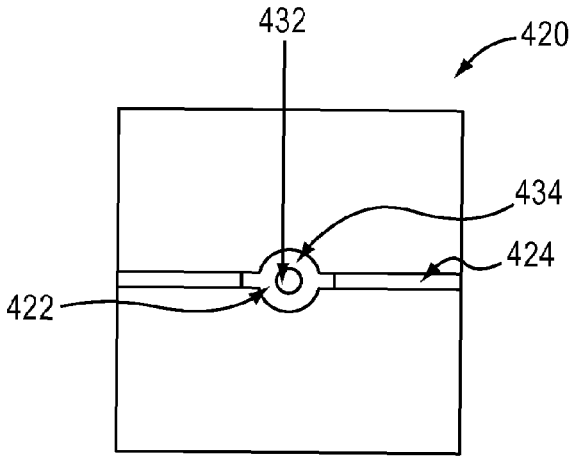
FIGS. 15 and 16 are a top view and a side view of a portion of the buoyant device according to an embodiment of the invention.
Figure 16:
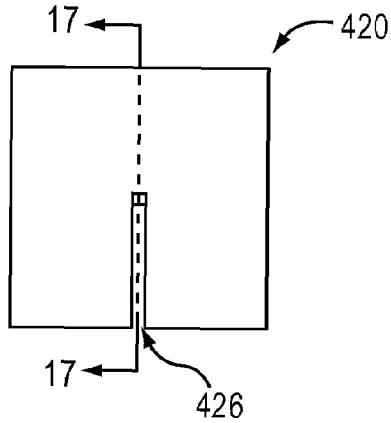
Figure 17:
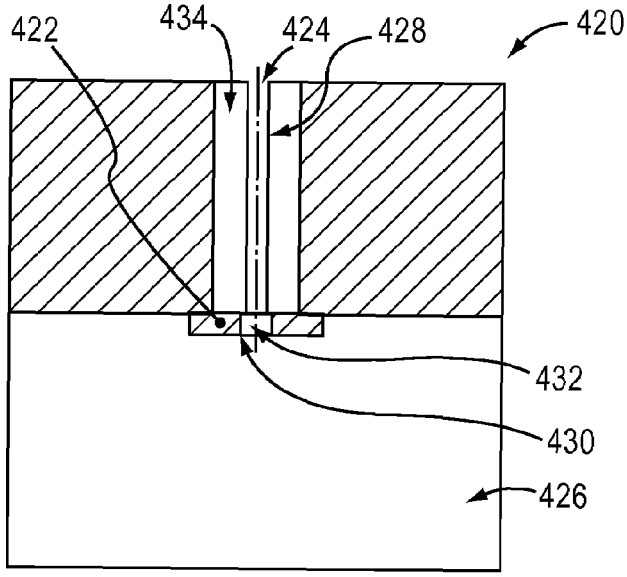
FIG. 17 is a cross-sectional view of the portion of the buoyant device along the line 17-17 of FIG. 16.

FIGS. 15 and 16 are a top view and a side view of a portion of the buoyant device according to an embodiment of the invention. A buoyant member 420 includes a first aperture 424 and a second aperture 426 and is coupled to an elongate member such that the elongate member extends from that first aperture 424 to that second aperture 426. The first aperture 424 including a substantially circular portion 434 located concentrically with the hole 432 defined by the portion of wall 428 defining the first aperture 424 and the portion of the wall 430 defining the second aperture 426. FIG. 17 is a cross-sectional view of the buoyant member 420 along the line 17-17 of FIG. 16. The substantially circular portion 434 of the first aperture 424 has a diameter smaller than a diameter defined by a retaining member to fixedly dispose the retaining member within the buoyant member 420. More specifically, the buoyant member 420 defines a retaining member cavity 422 substantially concentric with the hole 432.

Figure 18:
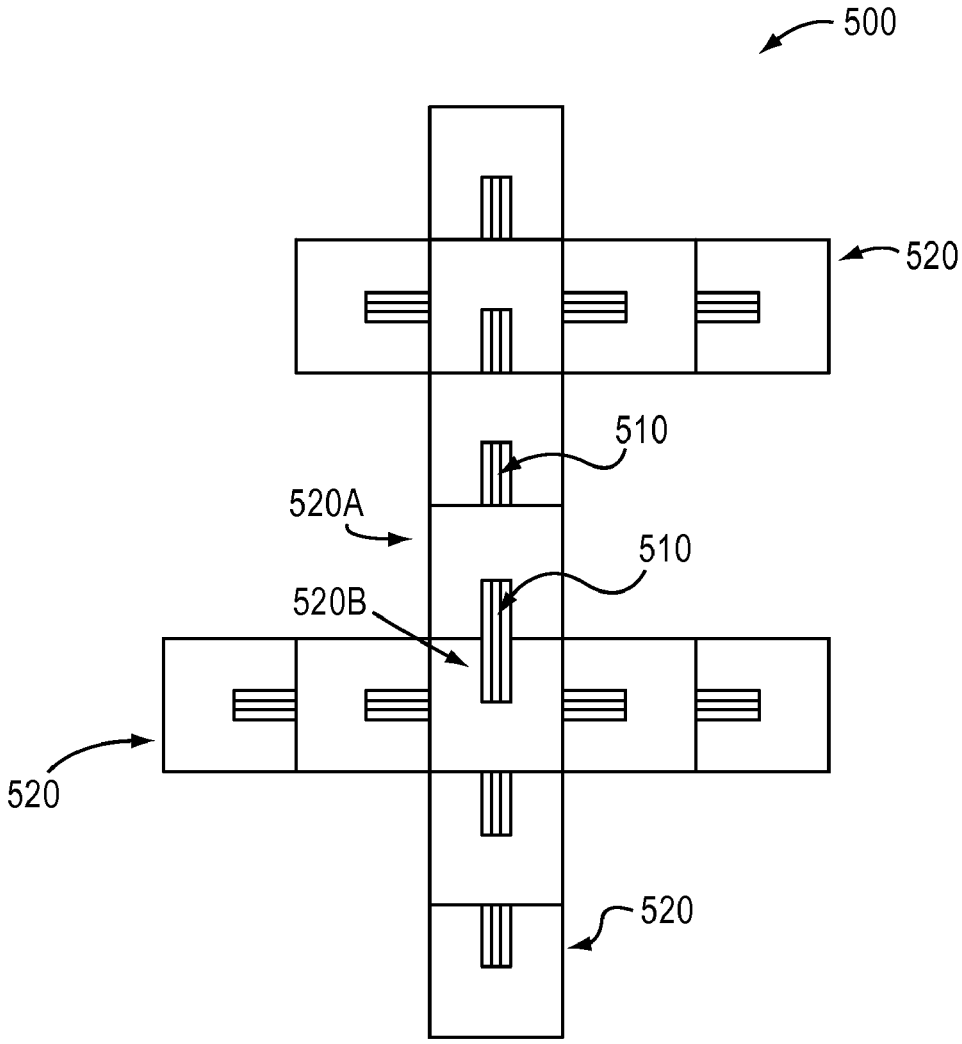
FIG. 18 is a side perspective view of a buoyant device according to an embodiment of the invention.

FIG. 18 is a side view of a buoyant device according to an embodiment of the invention. The buoyant device 500 includes multiple buoyant members 520 and multiple retaining members. In this embodiment, the buoyant device 500 includes multiple elongate members 510, each elongate member 510 extending from one buoyant member 520A to an adjacent buoyant member 520B. Each elongate member 510 is fixedly coupled to the retaining member of the buoyant member 520A and the retaining member of the adjacent buoyant member 520B. The multiple elongate members 510 permit the buoyant members 520 to define more geometric configurations as shown in FIG. 18. In this embodiment, each buoyant member 520 includes a retaining member configured to fixedly retain one or more elongate members. In an alternative embodiment, the elongate member can be fixedly coupled to multiple buoyant members. In some embodiments, multiple elongate members extend from one buoyant member to an adjacent buoyant member.

Figure 19:
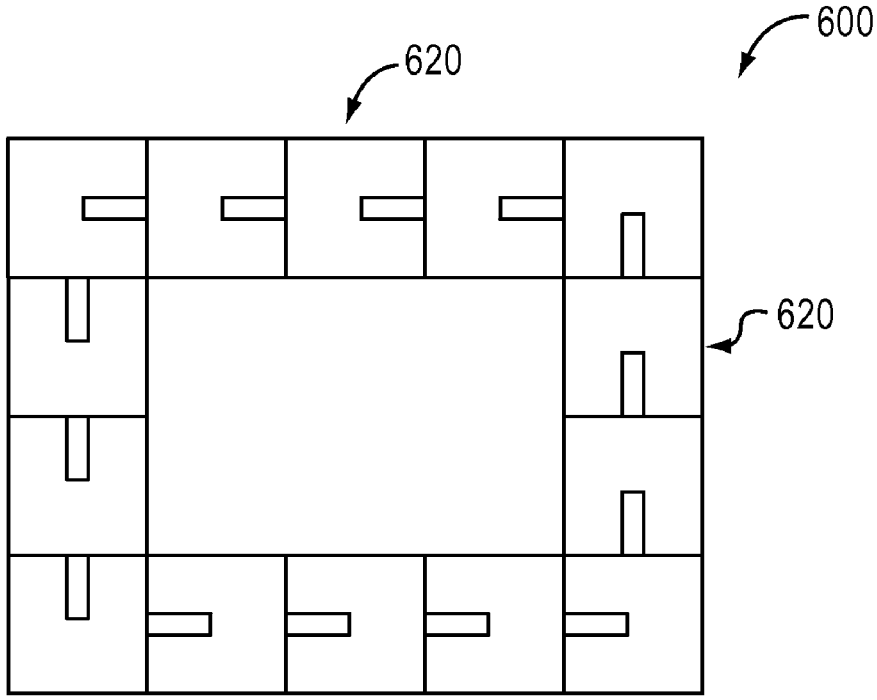
FIG. 19 is a side view of a buoyant device according to an embodiment of the invention.

In another alternative embodiment, the buoyant members 620 of the buoyant device 600 collectively form an enclosed loop as shown in FIG. 19. In other embodiments, the buoyant members of the buoyant device collectively form more complex shapes without free ends.

Figure 20:
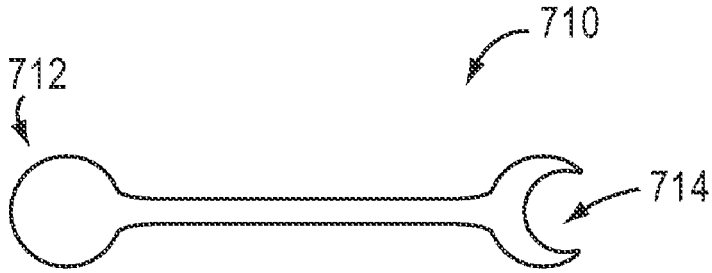
FIG. 20 is a side perspective of a portion of a buoyant device according to an embodiment of the invention.

In yet another alternative embodiment, the elongate member includes the retaining member and is configured to releasably couple to one or more elongate members. In this embodiment, the buoyant device includes an elongate member 710 having a first end portion 712 and a second end portion 714 opposite the first end portion 712 as shown in FIG. 20. The first end portion 712 of the elongate member 710 is configured to releasably couple to a second end portion of another elongate member (e.g., similar to second end portion 714). The second end portion 714 of the elongate member 710 is configured to releasably couple to a first end portion of another elongate member (e.g., similar to first end portion 712). In this embodiment, the first end portion 712 defines a ball shape. The second end portion 714 defines a socket configured to receive the ball shape from a first end portion from another elongate member. Similarly, the first end portion 712 is configured to receive the socket-type end portion from another elongate member.

Figure 21:
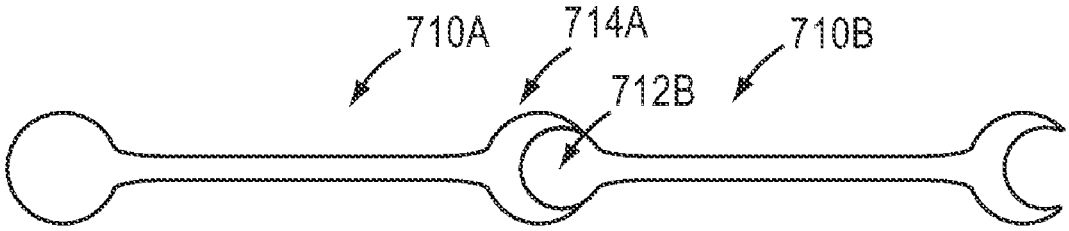
FIG. 21 is a side view of a portion of a buoyant device according to an embodiment of the invention.

In another example, the first end portion 712B of a first elongate member 710B can releasably couple to the second end portion 714A of a second elongate member 710A as shown in FIG. 21. The socket of the second end portion 714A has a width larger than a width associated with an aperture of a buoyant member to fixedly retain the socket within the buoyant member.

In one embodiment, the first elongate member 710B is associated with a single buoyant member and is configured to couple to the second elongate member 710A associated with another single buoyant member.

In another embodiment, the first elongate member 710B is associated with multiple buoyant members and is configured to couple to the second elongate member 710A associated with one or more other buoyant members. The first elongate member can be, for example, associated with three buoyant members: a first buoyant member, a second buoyant member, and a third buoyant member. The first end portion of the first elongate member that defines the ball shape can be disposed in the first buoyant member. The second end portion of the first elongate member that defines the socket can be disposed within the third buoyant member. The first elongate member can be disposed, in part, within the second buoyant member without disposing the ball defined by the first end portion nor the socket defined by the second end portion within the second buoyant member.

Figure 22:
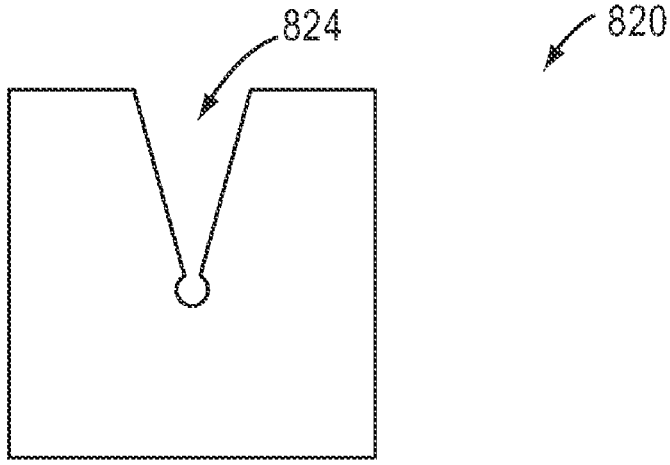
FIG. 22 is a side view of a portion of a buoyant device according to an embodiment of the invention.

FIG. 22 is a side view of a portion of a buoyant device, according to an embodiment of the invention. The buoyant member 820 defines a first aperture 824 and a second aperture. The first aperture 824 is shaped such that a width of the first aperture 824 at a distal end is greater than a width of the first aperture 824 at a center as shown in FIG. 22. The buoyant member 820 is configured to releasably couple to the elongate member. In some embodiments, the buoyant member is permitted to flex to facilitate the coupling and decoupling of the elongate member from the buoyant member. In some embodiments, the second aperture of the buoyant member is shaped the same as the first aperture.

Figure 22A:
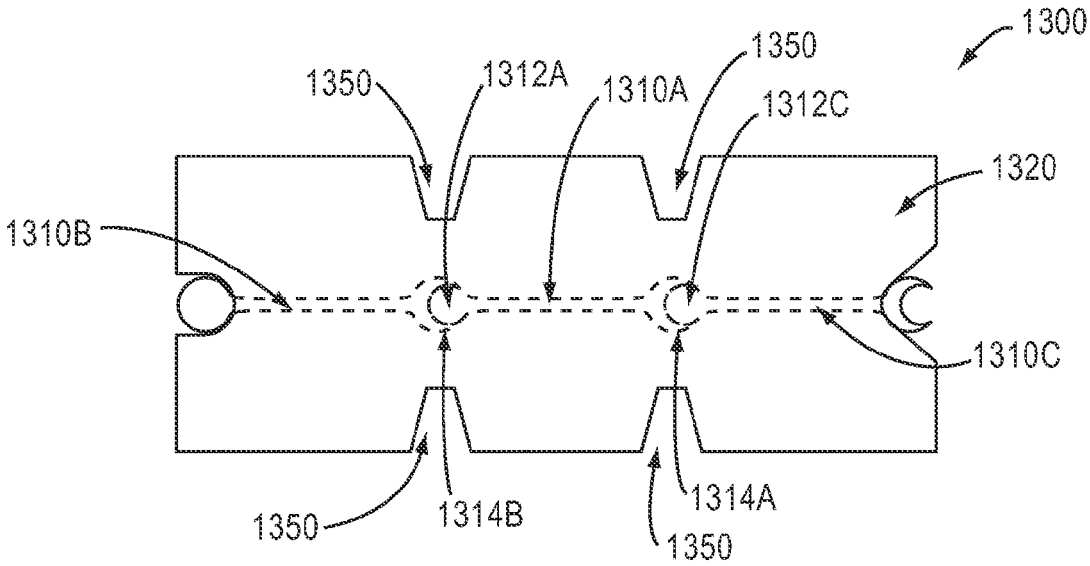
FIGS. 22A and 22B are side views showing internal components of a buoyant device according to various embodiments of the invention.

FIG. 22A is a side view of a buoyant device with internal components shown in phantom, according to an embodiment of the invention. The buoyant device 1300 includes a buoyant member 1320, a first elongate member 1310A, a second elongate member 1310B and a third elongate member 1310C. Each of the elongate members 1310 has a first end portion 1312 that defines a ball shape and a second end portion 1314 that defines a socket shape as described in the above embodiments. The buoyant member 1320 is coupled to each of the elongate members 1310. The buoyant member 1320 defines a first aperture (not shown) and a second aperture (not shown). At least one of the elongate members 1310 is coupled to the buoyant member 1320 such that the elongate members 1310 extend from the first aperture to the second aperture. The second end portion 1314B of the second elongate member 1310B is coupled to the first end portion 1312A of the first elongate member 1310A. The first end portion 1312C of the third elongate member 1310C is coupled to the second end portion 1314A of the first elongate member 1310A. The buoyant member 1320 is coupled to each of the elongate members 1310. In other words, multiple elongate members are associated with one buoyant member. The buoyant member 1320 defines multiple slots or rings 1350 to permit the buoyant member 1320 to flex or bend. In some embodiments, the buoyant member 1320 can maintain a flexed or bent shape.

Figure 22B:
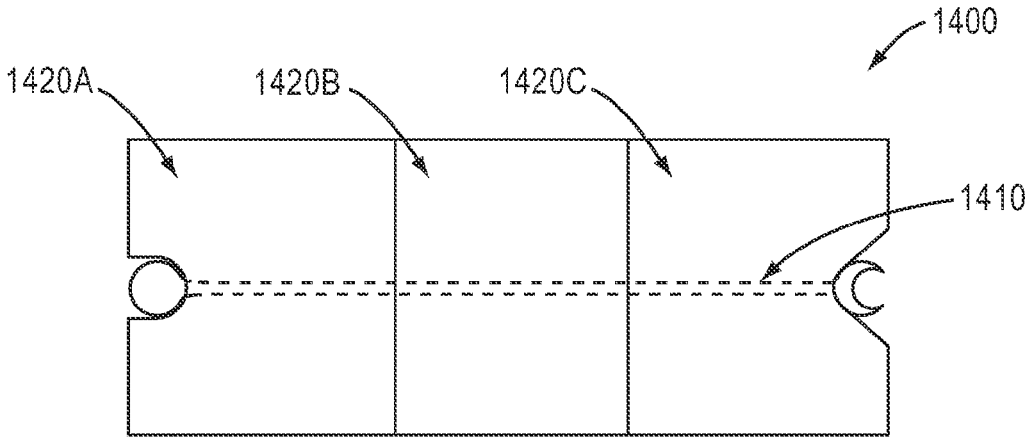

FIG. 22B is a side view of a buoyant device with internal components shown in phantom, according to an embodiment of the invention. The buoyant device 1400 includes a first buoyant member 1420A, a second buoyant member 1420B, a third buoyant member 1420C and an elongate member 1410. Each of the buoyant members 1420 define a first aperture (not shown) and a second aperture (not shown). Each of the buoyant members 1420 are coupled to the elongate member 1410 such that the elongate member 1410 extends from that first aperture to that second aperture for each respective buoyant member. In other words, one elongate member is associated with multiple buoyant members. In some alternative embodiments, multiple elongate members can be associated with multiple buoyant members.

Figure 23:
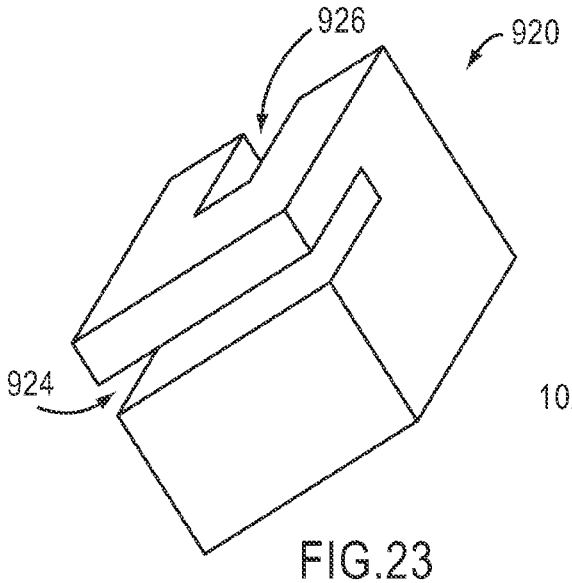
FIGS. 23-25 are perspective views of a portion of a buoyant device according to various embodiments of the invention.
Figure 24:
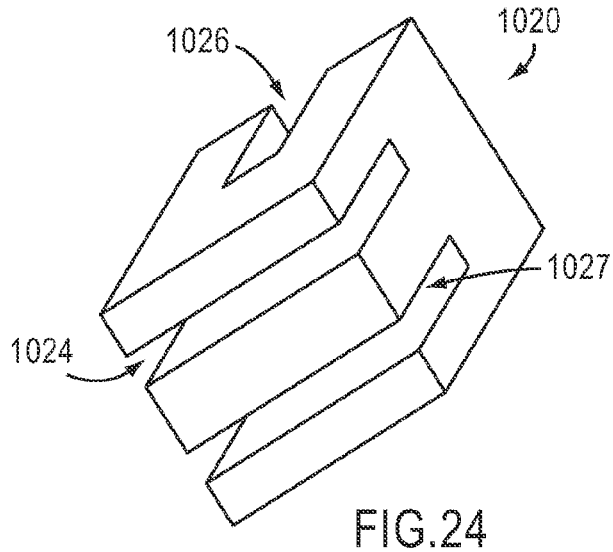
Figure 25:
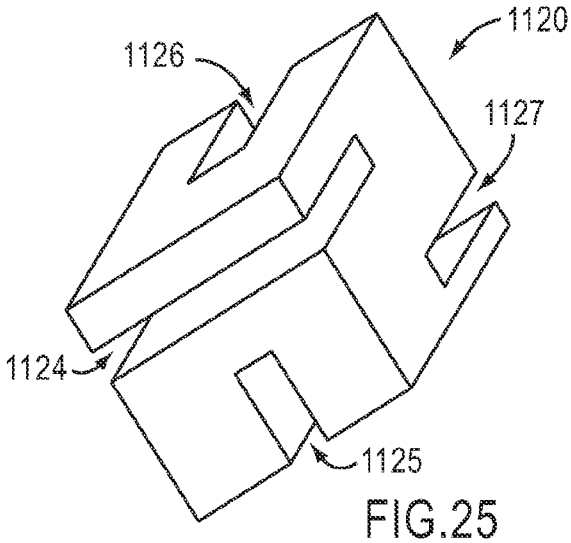

FIGS. 23-25 are perspective views of a portion of a buoyant device according to various embodiments of the invention. In one embodiment, the hole defined by the first aperture 924 and the second aperture 926 of the buoyant member 920 is off center as shown in FIG. 23. In another embodiment, the buoyant member 1020 includes a third aperture 1027 as shown in FIG. 24. Specifically, at least a portion of both the first aperture 1024 and the third aperture 1027 intersect the second aperture 1026.

Figure 26:
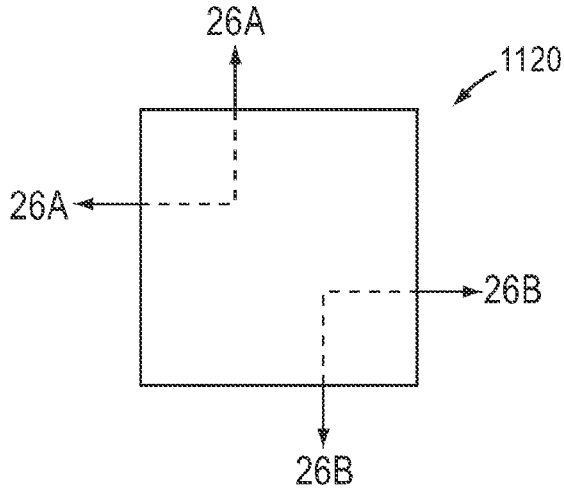
FIG. 26 is a side view of the portion of the buoyant device of FIG. 25.

In another embodiment, the buoyant member 1120 defines a first aperture 1124, a second aperture 1126, a third aperture 1125 and a fourth aperture 1127 as shown in FIG. 25. The buoyant member 1120 is coupled to a first elongate member such that the first elongate member extends from first aperture 1124 to second aperture 1126. The buoyant member 1120 is coupled to a second elongate member such that the second elongate member extends from third aperture 1125 to fourth aperture 1127. Specifically, the lines 26A-26A and 26B-26B of FIG. 26 illustrate one of a variety of orientations of the first elongate member and the second elongate member, respectively. More specifically, the buoyant member 1120 is configured such that the first elongate member and the second elongate member do not intersect.

Figure 27:
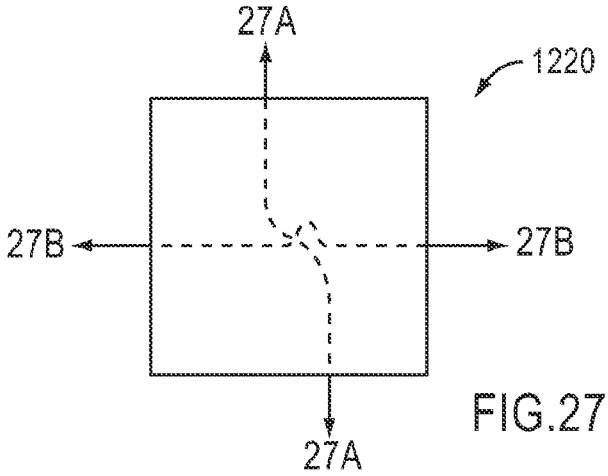
FIG. 27 is a side view of a portion of a buoyant device according to an embodiment of the invention.

In some embodiments, the buoyant member 1120 is configured such that the first elongate member, corresponding to line 27A-27A, passes over the second elongate member, corresponding to line 27B-27B, as shown in FIG. 27.

Figure 28:
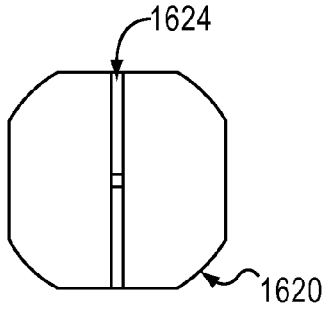
FIGS. 28-30 are side views of a portion of a buoyant device according to an embodiment of the invention.
Figure 29:
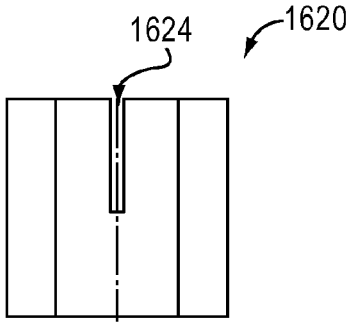
Figure 30:
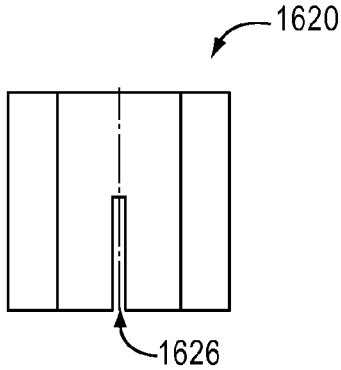

FIGS. 28-30 are side views of a portion of a buoyant device according to an embodiment of the invention. The buoyant member 1620 defines a first aperture 1624 and a second aperture 1626. In this embodiment, the buoyant member 1620 has an octagonal shape.

Figure 31:
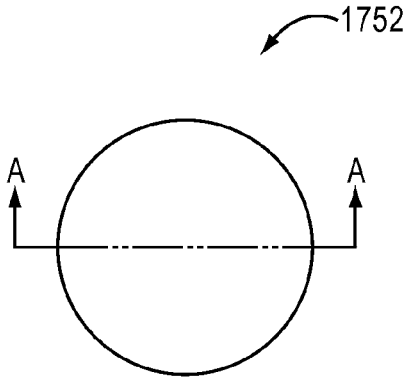
FIGS. 31-33 are side views of a portion of a buoyant device according to an embodiment of the invention.
Figure 32:
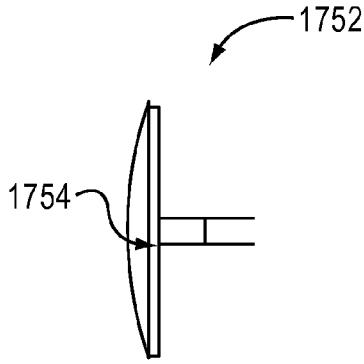
Figure 33:
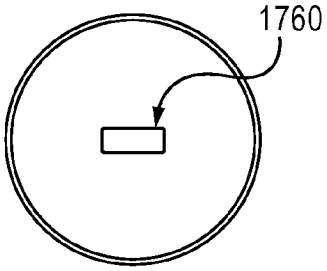
Figure 34:
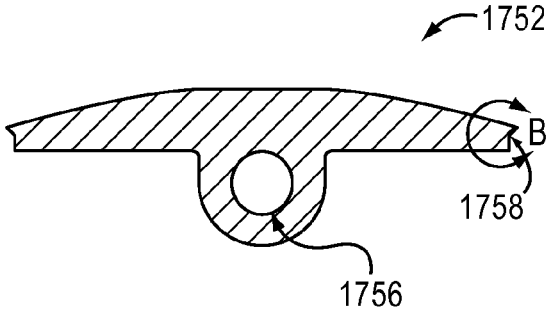
FIG. 34 is a cross-sectional view of the portion of the buoyant device of FIG. 31.
Figure 35:
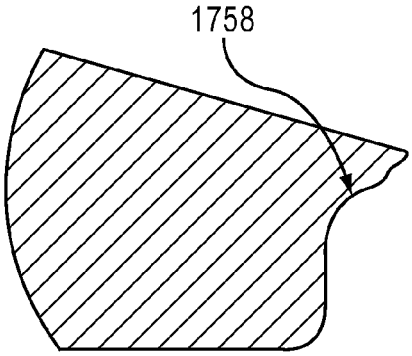
FIG. 35 is an enlarged view of a portion of FIG. 34.
Figure 36:
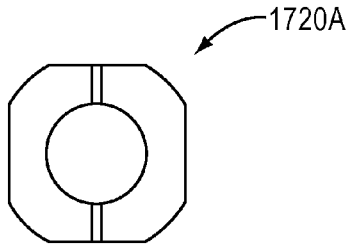
FIG. 36 is a side view of a portion of a buoyant device according to an embodiment of the invention.
Figure 37:
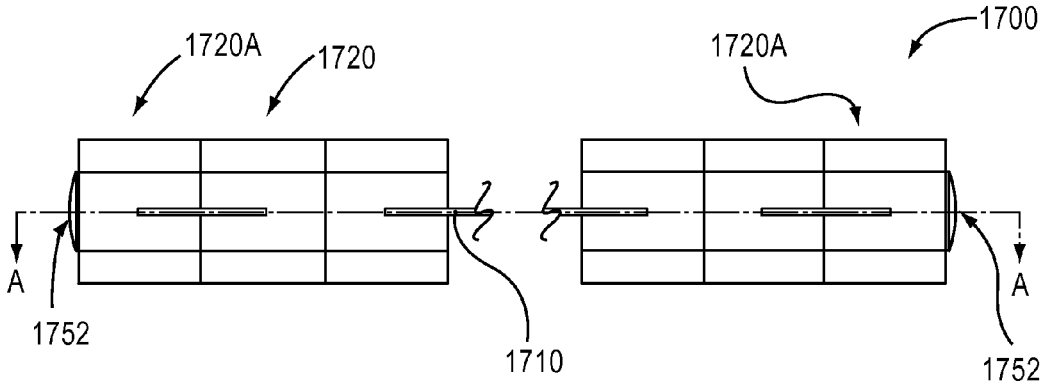
FIG. 37 is a side view of a buoyant device including the portion of the buoyant device of FIG. 36.
Figure 38:
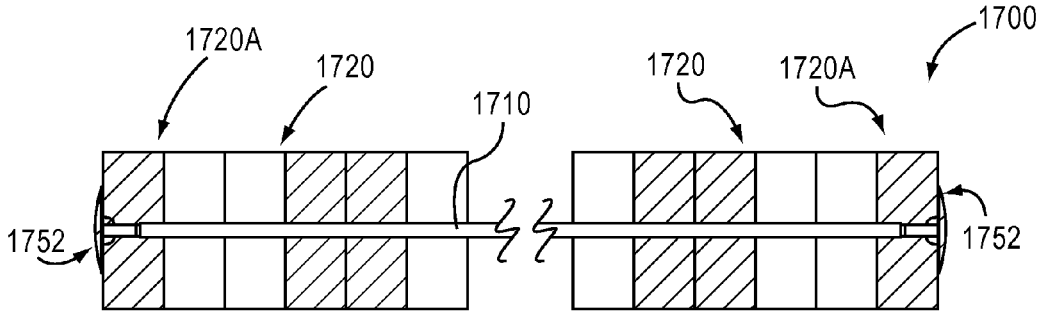
FIG. 38 is a cross-sectional view of the buoyant device of FIG. 38.

FIGS. 31-33 are side views of a portion of a buoyant device according to an embodiment of the invention. An end cap 1752 is configured to help retain the elongate member 1710 within the buoyant members 1720 and to help maintain an adjacent configuration of the buoyant device 1700 as shown in FIG. 37. FIG. 38 is a cross-sectional view of FIG. 37 along line A-A. Specifically, the end cap 1752 has an inner retention surface 1754 configured to engage an end buoyant member 1720. FIG. 36 is a side view of the end buoyant member 1720. The end cap 1752 has a connection portion 1760 that defines a lumen 1756 therethrough. The lumen 1756 is configured to receive the elongate member 1710. FIG. 34 is a cross-sectional view of FIG. 31 along line A-A. FIG. 35 is an enlargement of a ridge portion 1758 of FIG. 34 along line B. The ridge portion 1758 is configured to help the end cap 1752 retain a fixed position with respect to the end buoyant member.

While various embodiments of the invention have been described above, it should be understood that they have been presented by way of example only, and not limitation. Thus, the breadth and scope of the invention should not be limited by any of the above-described embodiments, but should be defined only in accordance with the following claims and their equivalents. While the invention has been particularly shown and described with reference to specific embodiments thereof, it will be understood that various changes in form and details may be made.

For example, a buoyant device can include various combinations and sub-combinations of the various embodiments described herein.

What is claimed is:

1. An apparatus, comprising:

a plurality of buoyant members;

a first elongate member slidably coupled to the plurality of buoyant members, the plurality of buoyant members collectively having a buoyancy and including a synthetic material, the plurality of buoyant members configured to be used in a liquid;

a connector coupled to the first elongate member, the connector configured to releasably couple a first end portion of the first elongate member to a second elongate member; and a retaining member coupled to the first elongate member and a buoyant member from the plurality of buoyant members, the retaining member and the first elongate member collectively configured to limit a distance between two adjacent buoyant members from the plurality of buoyant members, the plurality of buoyant members are selectively positionable with respect to the first elongate member to define a user-specified geometric configuration.

2. The apparatus of claim 1, wherein the plurality of buoyant members is configured to support a weight of an average user such that at least a portion of the user is above a surface of the liquid when disposed within the liquid.

3. The apparatus of claim 1, wherein each buoyant member from the plurality of buoyant members defines a first aperture and a second aperture, the first elongate member extends from the first aperture to the second aperture of each buoyant member from the plurality of buoyant members.

4. The apparatus of claim 1, wherein each buoyant member from the plurality of buoyant members defines a first aperture and a second aperture, the first elongate member extends from the first aperture to the second aperture of each buoyant member from the plurality of buoyant members such that the distance between two adjacent buoyant members from the plurality of buoyant members is limited less than three inches.

5. The apparatus of claim 1, wherein the plurality of buoyant members has a specific gravity that is substantially maintained while used in the liquid.

6. The apparatus of claim 1, wherein the plurality of buoyant members has a length no less than two feet.

7. The apparatus of claim 1, further comprising a plurality of retaining members, the retaining member being from the plurality of retaining members, each retaining member from the plurality of retaining member being fixedly coupled to the first elongate member and fixedly coupled to a buoyant member from the plurality of buoyant members.

8. The apparatus of claim 1, wherein the plurality of buoyant members collectively form an elongate body.

9. The apparatus of claim 1, wherein the first elongate member is an elastic member, the first elongate member is coupled to the plurality of buoyant members with a tension such that the distance between two adjacent buoyant members from the plurality of buoyant members is less than three inches.

10. The apparatus of claim 1, wherein a buoyant member from the plurality of buoyant members is a polyhedron block.

11. An apparatus, comprising:

a plurality of buoyant members; and a first elongate member slidably coupled to the plurality of buoyant members with a tension such that a maximum distance between two adjacent buoyant members from the plurality of buoyant members is between one inch and three inches, the first elongate member being elastic, the plurality of buoyant members collectively having a buoyancy, the plurality of buoyant members is configured to support a weight of an average user such that at least a portion of the user is above a surface of the liquid when disposed within the liquid, the plurality of buoyant members are selectively positionable with respect to the first elongate member to define a user-specified geometric configuration; and a connector coupled to the first elongate member, the connector configured to releasably couple a first end portion of the first elongate member to a second elongate member.

12. The apparatus of claim 11, wherein the plurality of buoyant members has a specific gravity that is substantially maintained while used in the liquid.

13. The apparatus of claim 11, wherein the plurality of buoyant members has a length no less than two feet.

14. An apparatus, comprising:

a first elongate member having a first end portion and a second end portion opposite the first end portion, the first end portion of the first elongate member configured to releasably couple to an end portion of a second elongate member, the second end portion of the first elongate member configured to releasably couple to an end portion of a third elongate member; and a buoyant member defining a first aperture and a second aperture, the buoyant member being coupled to the first elongate member such that the first elongate member extends from that first aperture to that second aperture.

15. The apparatus of claim 14, wherein the buoyant member is a first buoyant member, the apparatus further comprising:

a second buoyant member; and a third buoyant member, the first end portion of the first elongate member defines a ball shape configured to receive a socket from an end portion of the second buoyant member, the second end portion of the first elongate member defines a socket configured to receive a ball shape from a first end portion of the third buoyant member.

16. The apparatus of claim 14, wherein the buoyant member is from a plurality of buoyant members, the elongate member is configured to retain each buoyant member from the plurality of buoyant members.

17. The apparatus of claim 14, wherein the buoyant member is from a plurality of buoyant members, the elongate member is configured to limit a distance between two adjacent buoyant members from the plurality of buoyant members.

18. The apparatus of claim 14, wherein the buoyant member is from a plurality of buoyant members, the elongate member is configured to limit a distance between two adjacent buoyant members from the plurality of buoyant members to less than three inches.

19. The apparatus of claim 14, wherein the buoyant member is from a plurality of buoyant members collectively having a buoyancy configured to support a weight of an average user such that at least a portion of the user is above a surface of a liquid when disposed within the liquid.

20. The apparatus of claim 14, wherein the buoyant member is from a plurality of buoyant members selectively positionable with respect to the elongate member to define a user-specified geometric configuration.

21. The apparatus of claim 14, wherein the buoyant member is from a plurality of buoyant members, the elongate member is substantially taut and configured to hold the plurality of buoyant members in an adjacent arrangement.

22. The apparatus of claim 14, wherein the buoyant member is from a plurality of buoyant members collectively form an elongate body.

23. The apparatus of claim 14, wherein the buoyant member is from a plurality of buoyant members collectively having a buoyancy configured to support a portion of a weight of an average user when disposed within a liquid.

24. The apparatus of claim 14, wherein:

the first end portion of the first elongate member is releasably coupled to the end portion of the second elongate member, the second end portion of the of the first elongate member being releasably coupled to the end portion of the third elongate member.

25. The apparatus of claim 14, further comprising:

a first connector configured to be coupled to the first end portion of the first elongate member and the second elongate member; and a second connector configured to be coupled to the first end portion of the first elongate member and the third elongate member.

26. The apparatus of claim 14, wherein the first end portion of the first elongate member is coupled to the end portion of the second elongate member, the buoyant member being coupled to the second elongate member such that the second elongate member extends from that first aperture to that second aperture.

27. The apparatus of claim 14, wherein the buoyant member is a first buoyant member, the apparatus further comprising:

a second buoyant member defining a first aperture and a second aperture, the second buoyant member being coupled to the first elongate member such that the first elongate member extends from the first aperture of the second buoyant member to the second aperture of the second buoyant member; and a third buoyant member defining a first aperture and a second apertures, the third buoyant member being coupled to the first elongate member such that the first elongate member extends from the first aperture of the third buoyant member to the second aperture of the third buoyant member.

28. The apparatus of claim 14, wherein:

the buoyant member is from a plurality of buoyant members; and the first elongate member is from a plurality of elongate members, each of the buoyant members from the plurality of buoyant members is coupled to at least two of the elongate members from the plurality of elongate members.

* * * * *